US005511881A

United States Patent [19]

Post et al.

[11] Patent Number: 5,511,881

[45] Date of Patent: Apr. 30, 1996

[54] IMPELLER SYSTEM AND METHOD FOR ENHANCED-FLOW PUMPING OF LIQUIDS

[75] Inventors: Thomas A. Post; Richard A. Howk, both of Pittsford; Michael J. Preston, Spencerport, all of N.Y.

[73] Assignee: General Signal Corporation, Stamford, Conn.

[21] Appl. No.: 369,622

[22] Filed: Jan. 6, 1995

[51] Int. Cl.[6] ..... B01F 5/12

[52] U.S. Cl. ..... 366/263; 366/155.1; 415/211.2

[58] Field of Search ..... 366/262, 263, 366/264, 265, 270, 155.1, 163.1, 164.1, 164.6, 317; 415/211.2

[56] References Cited

U.S. PATENT DOCUMENTS

| | | | |
|---|---|---|---|
| 57,089 | 8/1866 | Close . | |
| 1,084,210 | 1/1914 | Howard . | |
| 1,374,446 | 4/1921 | Greenawalt . | |
| 2,530,814 | 11/1950 | Becze et al. . | |
| 2,658,455 | 11/1953 | Seinfeld . | |
| 2,769,623 | 11/1956 | Cawood . | |
| 3,159,106 | 12/1964 | Schumbacker et al. . | |
| 3,233,876 | 2/1966 | Faure et al. | 366/317 |
| 3,329,407 | 7/1967 | Clough | 366/317 |
| 3,362,689 | 1/1968 | Rothman | 366/317 |
| 3,746,467 | 7/1973 | Buse . | |
| 4,024,063 | 5/1977 | Mori . | |
| 4,468,130 | 8/1984 | Weetman . | |
| 4,628,391 | 12/1986 | Nyman et al. . | |
| 4,721,571 | 1/1988 | Nyman et al. . | |
| 4,722,608 | 2/1988 | Salzman et al. . | |
| 4,747,694 | 5/1988 | Nyman et al. . | |
| 4,786,187 | 11/1988 | Nyman et al. . | |
| 4,893,941 | 1/1990 | Wayte . | |
| 4,979,986 | 12/1990 | Hill et al. | 366/317 |
| 5,104,541 | 4/1992 | Daniel . | |
| 5,185,081 | 2/1993 | Nyman et al. . | |
| 5,318,360 | 6/1994 | Langer et al. . | |
| 5,336,050 | 8/1994 | Guida et al. . | |

OTHER PUBLICATIONS

The Design of Large Scale Mixer Settlers–J. B. Lott, G. C. I. Warwick, J. B. Scuffham–The Power–Gas Corporation Ltd. (1971).

The Design of Mixer–Settlers for Metallurgical Duties–G. C. I. Warwick & J. B. Scuffham (1972).

An Improved Settler Design in Hydrometallurgical Solvent Extraction Systems–I. D. Jackson, J. B. Scuffham, G. C. I. Warwick & G. A. Davies (1972).

*Primary Examiner*—Robert W. Jenkins

*Attorney, Agent, or Firm*—M. Lukacher

[57] ABSTRACT

A rotatably driveable enhanced-flow impeller system is provided for pumping at least one liquid in a tank through an outlet port thereof. A radial flow impeller has a first impeller face disposed proximate the bottom of the tank and proximate or extending into an inlet port for liquids in the tank bottom. The radial flow impeller has a plurality of blades with radially outermost blade tips terminating along a blade terminating circle. Disposed adjacent a second opposing face of the radial flow impeller is a radial flow extension plate which preferably extends radially outwardly along the second face by a radial distance beyond the blade terminating circle. The radial flow extension plate may be fixedly attached to the second impeller face. The enhanced-flow impeller system can be used advantageously in conjunction with an axial flow impeller disposed on a common drive shaft in an upper portion of the tank, to form with enhanced effectiveness a liquid—liquid dispersion as droplets of at least one liquid in at least one other immiscible liquid and to distribute the dispersion uniformly through the tank volume during a dispersion residence time in the tank.

47 Claims, 8 Drawing Sheets

IMPELLER SYSTEM AND METHOD FOR ENHANCED-FLOW PUMPING OF LIQUIDS

FIELD OF THE INVENTION

The present invention generally relates to pumping liquids, and more particularly, the invention relates in one aspect to an impeller system and method for enhanced-flow pumping of at least one liquid and it relates in another aspect to an impeller system and method for forming and enhanced-flow pumping of a dispersion of droplets of at least one liquid in at least one other immiscible liquid in a tank.

BACKGROUND OF THE INVENTION

In typical large-scale industrial mixing and pumping applications, a radial flow impeller, also referred to as a "pumper impeller," is disposed near the bottom of a tank filled with the liquid media to be mixed and to be pumped or just to be pumped through an outlet port of the tank located in an upper portion thereof. Such impellers, frequently open-faced on one face thereof and at least partially open-faced on another face thereof, are rotatably driven by a drive shaft which extends from the impeller to a gear box drive means usually positioned above the tank. Impeller rotation imparts to the liquid or liquids forces which generate in the liquid medium a so-called "head," a measure of the pressure the pumper impeller would generate in the liquid if the tank were completely closed. When the tank has an outlet port, the "head" provides flow of liquid through the outlet, the flow principally commensurate with the pumping effectiveness of the impeller the tank configuration and the volume and viscosity of the liquid or liquids to be pumped.

Various industrial mixing and pumping processes are based upon a "flow-through" principle, wherein a liquid or liquids are continuously provided at an inlet port for such liquids, frequently located at or integrated with the tank bottom. The radial flow impeller is usually arranged concentrically with the inlet port and in proximity thereto.

In the aforementioned applications of an open-faced "pumper impeller," the "head" and flow can be increased, at least in principle, by increasing the impeller's rotational speed. Such speed increase requires a higher power input to the drive shaft (and to the gear box drive means), and may result in accelerated wear and/or reduced mechanical integrity of the impeller, the drive shaft and the gear box drive means.

In addition to the aspects of "head" and flow, certain industrial tank-based mixing and pumping processes call for particular outcomes of a mixing and pumping process. For example, so-called solvent extraction processes have a first stage, referred to as mixer tank, in which a dispersion of droplets of one liquid is to be formed in another immiscible liquid by the action of an impeller, and the dispersion is to be pumped through an outlet port to subsequent process stages.

Briefly described, in a solvent extraction process one liquid is an aqueous liquid comprising a solution of metals in dilute sulfuric acid (derived in a prior leaching operation), and another liquid comprises organic fluids (for example kerosene and an extractant). These liquids are provided to the mixer tank through an inlet port (also referred to as an "orifice") located in the bottom of the mixer tank. Generally, a single radial flow inducing impeller (a "pumper impeller") is used near the bottom of the tank to pump the liquids, thereby mixing them and creating a dispersion of droplets of either the organic liquid or liquids in the aqueous liquids or, alternatively, to form a droplet dispersion of the aqueous liquids in the organic liquids, the organic liquid being referred to as the solvent. The selection of the one liquid which will form a droplet dispersion in the other, immiscible liquid, depends on numerous factors, including considerations of the respective liquid volumes, flow rates, choice of aqueous and organic liquids, as well as design considerations pertaining to the mixer tank and the impeller. The mixer tank has a baffled overflow region or weir through which the liquid droplet dispersion enters into a number of successive stirring tanks, eventually to reach a so-called settler stage in which the aqueous phase and the organic phase (the solvent) settle out by coalescence of the dispersed droplets. At respective outputs of the settler stage, the organic and aqueous liquids are drawn off for further processing steps in which the metal to be produced is extracted from the organic or the aqueous liquids (depending on whether the droplet dispersion was formed as solvent droplets in the aqueous continuous phase or as aqueous droplets dispersed in the organic continuous phase), and the solvent liquids are recovered for eventual recycling into the mixer tank. Since a large-scale industrial metallurgical solvent extraction process requires a substantial and continuous quantity of relatively costly organic (solvent) liquids, economic considerations drive the effectiveness of solvent extraction and solvent recovery.

For this reason, a central issue in such flow-through solvent extraction processes is the droplet size distribution of the droplet dispersion formed in the mixer tank under selected input flow rates of liquids for a selected impeller, tank design, and power level applied to the impeller shaft at a certain impeller rotational speed. A second issue is the efficiency of droplet formation, also referred to as hydraulic efficiency, under certain operating conditions of the mixer tank.

With respect to the size distribution of the droplet dispersion, it is well known that the mass transfer coefficient (a measure of the ability of transferring a mass of one liquid in a dispersed state into another liquid) increases significantly as the droplet size decreases. On the other hand, the coalescence rate of droplets in the dispersion increases rapidly with increasing droplet size, particularly at larger droplet diameters, thus potentially resulting in premature coalescence of droplets into a continuous phase prior to the dispersion reaching the settler stage of the solvent extraction system.

When the droplet size distribution of the dispersion generated in the mixer tank is shifted toward small droplet diameters, such as microdroplets, a phenomenon referred to as entrainment may adversely affect the downstream refining process of the metal, since, for example, very small droplets (microdroplets) of the organic liquids (solvent) may be permanently entrained in the aqueous phase at the settler stage of the process. Such entrainment also reduces the effectiveness of solvent recovery, since permanently entrained solvent droplets effectively constitute a loss of the organic liquids (solvent) in the case of the above example. Therefore, in order to resolve the potentially conflicting requirement of a desirably high mass transfer coefficient at small droplet sizes of the dispersion, having the attendant potential difficulty of entrainment, and the potentially premature coalescence of larger sized droplets, it is desirable to form in the mixer tank a relatively narrow droplet size distribution of the dispersion, an optimum droplet size approximately centered on a droplet diameter at which an acceptable mass transfer coefficient is desirably achieved with minimum potential for entrainment and yet having an acceptable droplet coalescence rate.

Even if operating conditions of a mixer tank do not yield such an ideal relatively narrow droplet size distribution, it is desirable to form a dispersion of non-entraining droplets or, stated differently, it is desirable to form a droplet dispersion devoid of very small droplets (microdroplets) prone to entrainment.

Some of the aforementioned considerations on the performance of a mixer tank of a solvent extraction plant, as well as other aspects thereof, have been described by Warwick and Scuffham in a publication entitled *The design of mixer-settlers for metallurgical duties* in the journal, *Hel Ingenieursblad*, 41*e jaargang* (1972), nr. 15.16, pages 442–449, and by Lott, Warwick, and Scuffham in a paper entitled *The design of large scale mixer settlers*, presented at the AIME Centennial Annual Meeting in 1971.

These authors describe the design of mixer-settlers of a solvent extraction process using a single pump-mix impeller with curved blades in the mixer tank to generate the dispersion of droplets from the organic and aqueous liquids, the mixer tank being followed immediately by a settler stage. Since the early 1970's, solvent extraction plants have evolved which include in their design one or several stirrer tanks disposed between the mixer tank and the settler stage.

As indicated in the foregoing, in a tank-based pumping system it is desirable to pump a liquid or liquids with an enhanced flow through an outlet port of the tank by an impeller in the tank. Such enhanced pumping at a given power applied to the impeller, and alternatively the non-enhanced pumping at a reduced impeller power input level, is desirable in applications using a liquid-filled tank with a closed tank bottom and in so-called flow-through systems.

In tank-based, flow-through pumping and mixing systems, it is desirable to pump and mix liquids with an enhanced liquid flow. In a particular, pumping and mixing process designed for effective operation of a mixer tank of a metallurgical solvent extraction facility, it is desirable to achieve enhanced-flow pumping and mixing of at least two immiscible liquids so as to form a dispersion of droplets of at least one liquid in at least one other liquid, wherein droplet sizes are desirably produced which result in non-entraining conditions in subsequent process stages of such a facility.

SUMMARY OF THE INVENTION

It is the principal object of the present invention to provide an enhanced-flow impeller system for pumping liquids in a tank through an outlet port thereof.

Another object of the invention is to provide an enhanced-flow impeller system for pumping and mixing liquids in a tank.

A further object of the present invention to provide an enhanced-flow impeller system for forming a dispersion of non-entraining droplets among at least two immiscible liquids in a single mixer tank of a metallurgical solvent extraction process.

Another object of the invention is to provide an improved impeller system for forming a droplet dispersion having a uniform spatial distribution of droplets throughout a mixer tank.

A further object of the present invention is to provide in a single tank a more efficient, improved impeller system which can pump and mix liquids in the tank at reduced power input to the impeller system.

Briefly described, the present invention provides, in one embodiment thereof, an enhanced-flow impeller system for pumping and mixing liquids in a single tank. One component of the impeller system of the invention is a radial flow impeller having on a first face thereof a plurality of radial flow inducing impeller blades disposed proximate the bottom of the tank in which the liquids are contained. Alternatively, the first impeller face is proximate a liquids inlet port at the tank bottom and coaxial therewith. In a currently preferred embodiment, the first impeller face is extending into the liquids inlet port. The radial flow impeller is attached to a drive shaft which can be rotatably driven by gear drive means.

Another component of the impeller system of the invention is a radial flow extension plate disposed adjacent a second opposing face of the radial flow impeller and extending radially outwardly therealong by a radial distance which is greater than the diameter of a circle described by the terminations of the tips of the impeller blades. The extension plate may be stationarily disposed adjacent the second impeller face by mounting the plate to the bottom or side walls of the tank. Alternatively, the extension plate may be fixedly attached to the second impeller face, whereby the plate and the impeller together are rotatably driven by the drive shaft. The radial flow extension plate may be a circular disk, either stationary or rotatable, when the tank has a cylindrical wall. The plate may have a regular polygonal perimeter, for example a square or hexagon shape, and is preferably a stationary (non-rotating) plate when the tank has a polygonal wall, for example a square or hexagon shaped wall.

A second embodiment in accordance with the present invention incorporates the inventive features and aspects of the enhanced-flow impeller system for pumping and mixing liquids in a mixer tank and extends the application of that system to the formation of a liquid—liquid dispersion of droplets of at least one liquid in at least one other immiscible liquid, and to providing the dispersion in a spatially uniform manner throughout the mixer tank during a dispersion residence time therein.

Optionally, an axial flow impeller attached to the common drive shaft in an upper portion of the mixer tank and rotatably driven by the shaft. The axial flow impeller has a plurality of pitched axial flow inducing blades with blade tips which extend radially outwardly to at least the blade tip terminating circle of the radial flow impeller.

An axial flow impeller having blades with a pitch so as to promote or induce an upwardly directed component of axial flow of the liquid dispersion of droplets may influence the type and droplet size distribution of a droplet dispersion in one particular manner. Likewise, selection of an axial flow impeller having blades with a pitch so as to promote or induce a downwardly directed component of axial flow of the liquid—liquid dispersion may influence the type and size distribution of a dispersion of droplets in a mixer tank in another particular manner.

With the enhanced-flow impeller system in accordance with the second embodiment of the present invention, a dispersion of droplets of a non-entraining droplet size distribution can be created in a lower portion of the mixer tank by stress inducing forces on the liquids entering the tank bottom through a liquids inlet port, and a uniform distribution of the thus created droplet dispersion throughout the mixer tank is provided by the axial component of the dispersion flow generated in the mixer tank by the axial flow impeller disposed in an upper portion of the mixer tank.

BRIEF DESCRIPTION OF THE DRAWINGS

The aforementioned and other objects, features and advantages of the present invention will be better understood and appreciated more fully from the following detailed description, taken in conjunction with the accompanying drawings, in which.

DETAILED DESCRIPTION OF THE EMBODIMENTS

Figure 1:
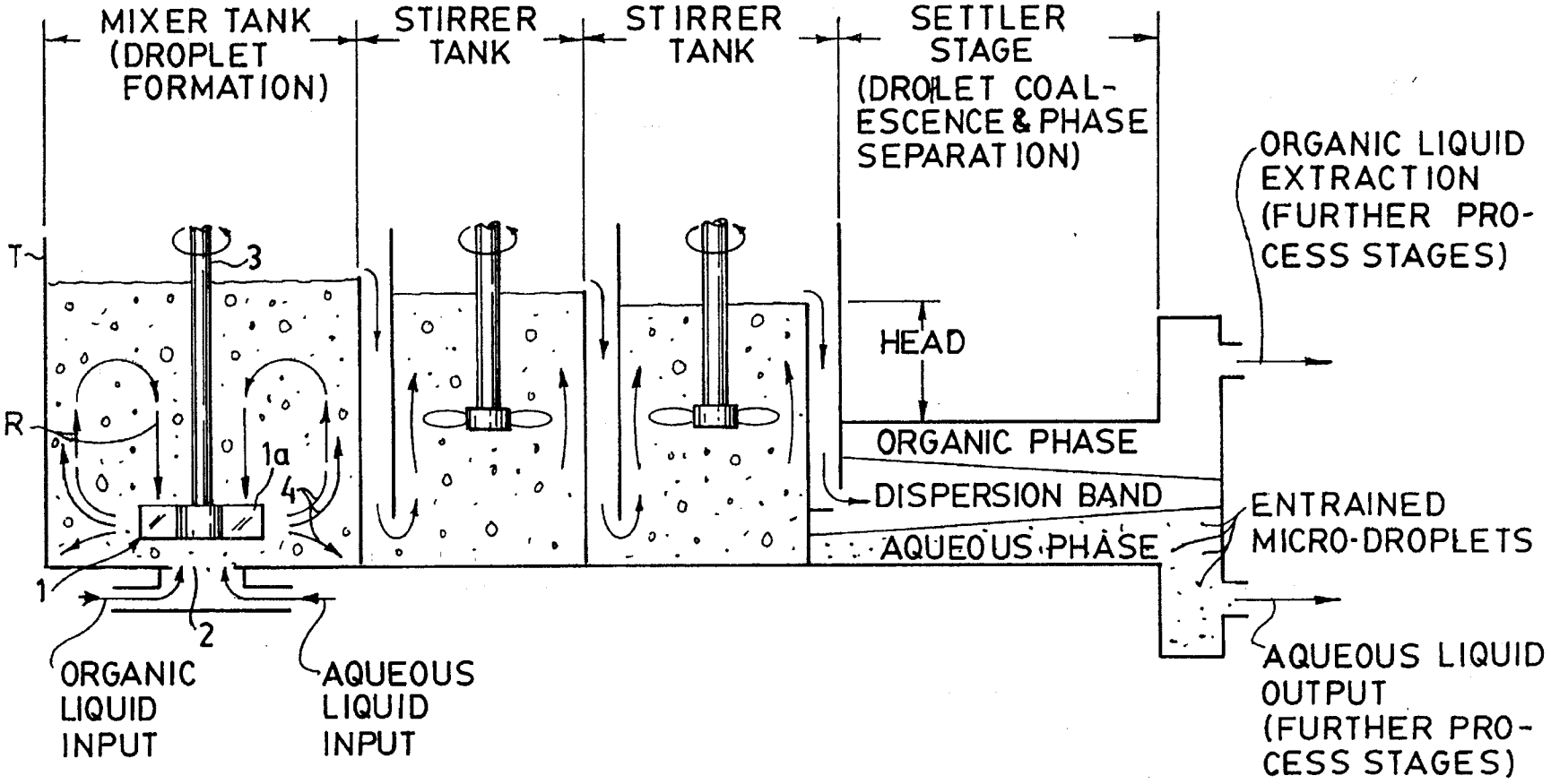
FIG. 1 PRIOR ART
FIG. 1 depicts a portion of a prior art metallurgical solvent extraction facility in which a single open-faced radial flow impeller is used in a mixer tank to form a droplet dispersion therein, followed by two stirrer tanks having axial flow impellers, and terminating in a settler stage from which the organic liquid (solvent) is removed for further processing and eventual recycling through the process, and from which an aqueous phase (for example, containing the metal of interest) is directed to further process stages.

Referring now to FIG. 1, there is shown a portion of a prior art metallurgical solvent extraction facility, including a mixer tank followed by two successive stirrer tanks and a settler stage. The mixer tank T has a conventional straight-bladed open radial flow impeller 1 disposed near the tank bottom proximate a liquids inlet port 2, the inlet port being provided organic liquids, for example an extractant in kerosene, and an aqueous liquid in the form of a solution, for example copper sulfate delivered in a certain concentration of sulfuric acid solution. The impeller 1 is rotatably driven by a drive shaft 3 to generate a droplet dispersion of either organic liquid droplets in a so-called continuous aqueous phase or, alternatively, to generate a dispersion of aqueous droplets in a continuous organic phase. Arrows generally designated at 4 indicate a somewhat divergent radial liquid flow generated by the radial flow impeller 1, and recirculation flow patterns in the tank T are designated at R. The impeller 1 provides the droplet dispersion by the pumping action imparted by the impeller blades 1*a* on the liquids in the tank.

An overflow of the droplet dispersion created in the mixer tank T is indicated by arrows to proceed through a baffled passageway to a first stirrer tank in which the dispersion is stirred by an axial flow impeller and from which the dispersion overflows through another baffled passageway to a second stirrer tank also having an axial flow impeller. From this latter stirrer tank the overflow is directed through a baffled passageway into a so-called settler stage wherein phase separation of the droplet dispersion is to be effected by droplet coalescence, thereby ideally providing an organic phase (i.e., the organic liquids originally provided at the inlet port of the mixer tank) and an aqueous phase. The organic liquids and aqueous liquids are directed to further process stages (not shown) for extracting the metals and for recovering the organic liquids (solvents) for eventual recycling to the mixer tank.

For illustrative purposes only, the mixer tank T of FIG. 1 is shown to produce a relatively wide droplet size distribution including numerous very small droplets (also referred to as microdroplets) indicated as dots in the dispersion. Such relatively wide droplet size distribution is common in mixer tanks which use open-faced straight-bladed radial flow impellers exerting a high shear force on the liquids. Such small droplets may remain permanently entrained in the settler stage, either as very small solvent droplets in the aqueous phase, as depicted in FIG. 1 or, alternatively, as very small aqueous droplets dispersed in the organic phase. In either event, such permanent entrainment of small droplets of one liquid in the other liquid causes difficulty in subsequent process steps such as the organic liquid recovery or the metal refining process steps.

Figure 2:
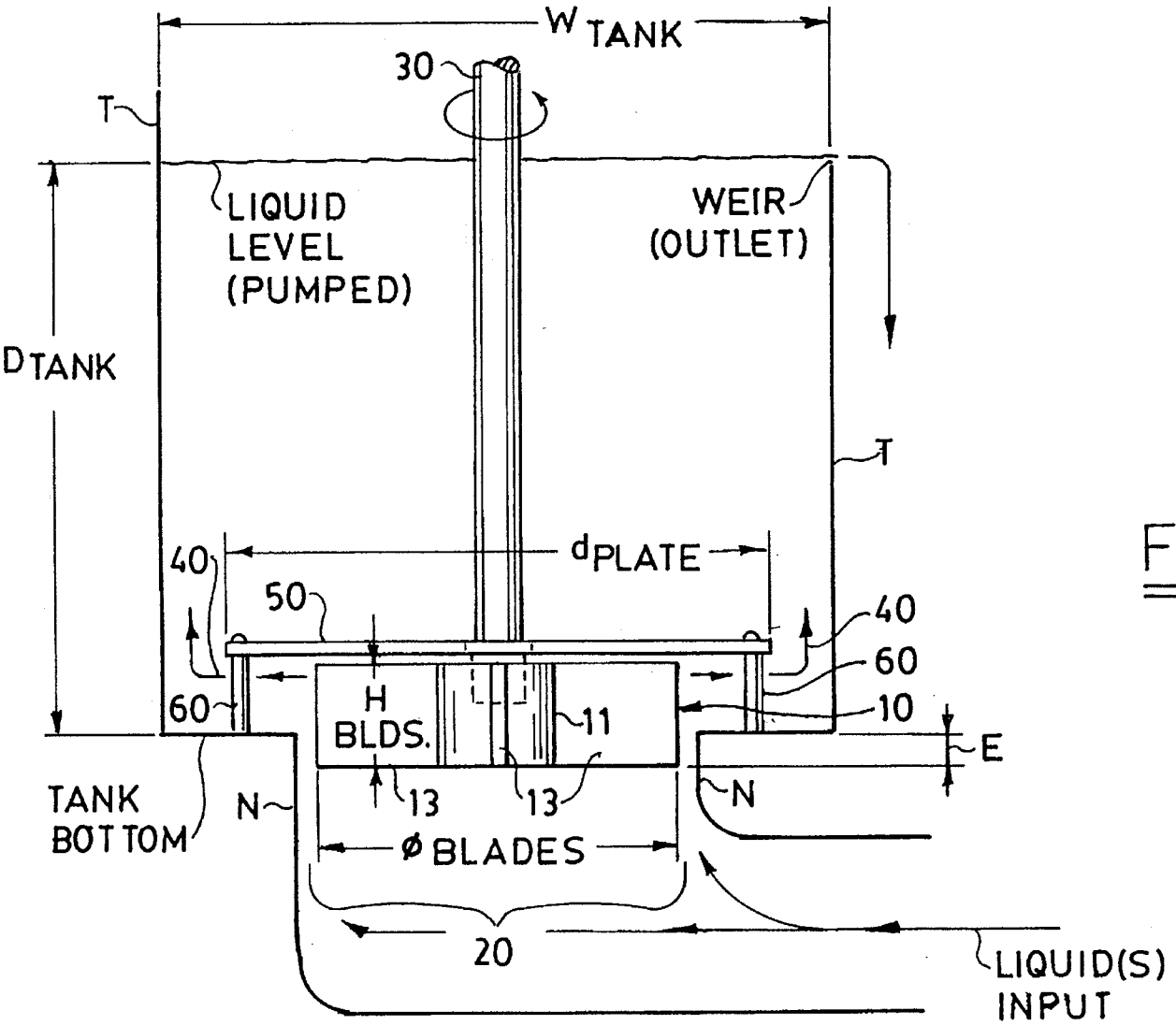
FIG. 2 is a schematic side view of a currently preferred enhanced-flow impeller system in accordance with a first embodiment of the present invention, the impeller system immersed and operative in a tank having a liquids inlet port at the tank bottom.

Referring now to FIG. 2, there is shown a schematic side view of a first embodiment of the invention of a currently preferred enhanced-flow impeller system for pumping a liquid or liquids in a tank from an inlet port through an outlet port or over a weir.

A tank T, which may have cylindrical side walls or walls shaped in the form of a regular polygon, for example a square or a hexagon, has an inlet port 20 extending over a portion of the tank bottom for providing an input of the liquid or liquids to be pumped by the impeller system in the tank. The tank T is shown to have a width dimension $W_{TANK}$, and a tank depth $D_{TANK}$ from the tank bottom to the weir or outlet. The inlet port 20 for the liquid(s) is depicted with a cylindrical neck portion N extending to the tank bottom.

A radial flow impeller, also referred to as a pumper impeller, generally designated at 10, has a plurality of radial flow inducing impeller blades 13 of a blade height $H_{BLADES}$. A lower or first face of the impeller 10 is shown schematically as extending downwardly into the neck portion N by a distance E.

The radial flow impeller 10 of FIG. 2 is depicted with a hub 11 to which a rotatably driven drive shaft 30 is attached. Numerous other approaches are known for mounting a metallic drive shaft to a metallic impeller, including welding, brazing, and by the use of bolts, threads, and the like. When the impeller and the drive shaft are of fibrous and plastic materials, known bonding methods may be used, for example thermal or adhesive bonding. Thus, the hub 11 is shown for illustrative purposes only.

The radial flow inducing blades 13 of the impeller 10 are shown to have radially outermost blade tips which terminate at a blade terminating circle of a diameter $Ø_{BLADES}$ which is smaller than the diameter of the cylindrical neck portion N of the inlet port 20.

A radial flow extension plate 50 is disposed adjacent an upper or second face of the radial flow impeller 10. The plate 50 extends radially outwardly parallel to the upper impeller face by a radial distance beyond the blade terminating circle $Ø_{BLADES}$, and has a radial extent $d_{PLATE}$. The radial flow extension plate 50 is stationarily disposed adjacent to the upper impeller face and is shown mounted to the tank bottom by studs or rods 60. The plate 50 can also be mounted to the side walls of the tank T by radial brackets and the like (not shown).

The peripheral outline of the radial flow extension plate 50 is preferably circular when installed in a tank T having cylindrical side walls, and the outline may be that of a regular polygon, for example a square or a hexagon, when installed in a tank of respectively similar polygon-shaped side walls, but a circular plate 50 may be used in a polygonal tank or vice versa, i.e., the periphery of the plate need not match the shape of the walls of the tank.

The radial flow extension plate 50 radially extends the radial flow component of the liquid(s) being pumped, as indicated by flow lines 40, compared to the more divergent radial flow produced by the open-faced impeller 1 with flow lines 4 (see FIG. 1).

During laboratory investigations of radial flow patterns induced by a variety of straight-bladed and curved-bladed radial flow impellers, significant recirculation flow (such as indicated at R in FIG. 1) was observed in a laboratory tank. Since significant recirculation of a droplet dispersion is thought to be adversely affecting the efficiency of forming the dispersion, various efforts were made to disrupt or minimize such recirculation flow. Quite surprisingly, it was found that a plate positioned stationarily adjacent an upper or second impeller face and extending radially outwardly beyond the impeller blade tips had a marked and unexpected influence on both the effectiveness of pumping liquids and the size distribution of droplets generated by the impeller 10 by any of the radial-flow impellers studied when used in conjunction with a stationary plate 50. Similarly unexpected observations were made when a circular radial flow extension disk was fixedly attached to the upper or second impeller face so that the disk and the impeller were rotatably driven together. In particular, it was found that such impeller/plate combinations could pump liquids at about a 3×enhanced flow rate between an inlet port and through an outlet port of the tank when using constant speed delivered to a drive shaft. Alternatively, at a normal feed rate of liquids through an input port 20, a dispersion could be produced by the impeller/plate combination at substantially reduced drive speed imparted to the drive shaft 30. Equally surprisingly, the droplet size distribution generated by this combination was substantially free of very small and potentially entrainable microdroplets.

Non-rotating plates 50 of various dimensions and shapes were subsequently investigated to verify and optimize the originally observed effects on liquid flow and droplet size distribution. With respect to the plate dimension $d_{PLATE}$ it was found that the aforementioned unexpected and desirable features could be partially achieved when the ratio $d_{PLATE}$/blade terminating circle was greater than about 1.1. At a ratio greater than about 1.33 (an 8-inch to 10-inch diameter plate over a 6-inch diameter impeller) the desirable effects were fully evident. With respect to shapes of plates 50, it was observed that circular disks, as well as regular polygonal shapes, including a square-shaped plate, performed equally well in conjunction with a selected radial flow impeller. It was noticed, for example, that a stationary square-shaped plate 50 positioned adjacently above an impeller 10 could be advantageously used in a square-shaped mixer tank T, whereas a stationary circular plate could be readily retrofitted above an impeller 10 immersed in a cylindrical mixer tank.

Thus, an immediate practical advantage of using a stationary radial flow extension plate 50 is to retrofit existing mixer tank installations used for pumping of liquids or for forming dispersions with a suitably dimensioned and shaped plate so that such operating systems can benefit from the enhanced-flow pumping or, alternatively from a reduced power requirement to the impeller drive shaft and, in dispersion-forming applications, provide a dispersion substantially free of entrainable droplets. Such retrofitting in the field can be accomplished by disconnecting the drive shaft 30 from its gear drive and motor assembly (not shown) and to slide a plate 50 through a central bore therein over the drive shaft, and suitably fastening the plate either to the tank bottom via studs or legs 60 or, alternatively, to fasten the plate on the walls of the mixer tank T by suitably arranged brackets and the like. As indicated previously, such retrofitting of a radial flow impeller 10 with a radial flow extension plate 50 has to be performed in consideration of features of the mixer tank T such as the width of the tank WTANK, the shape of the mixer tank and other aspects of a pre-existing mixer tank which may influence the selection of the fastening method of the plate to the tank.

Figure 3:
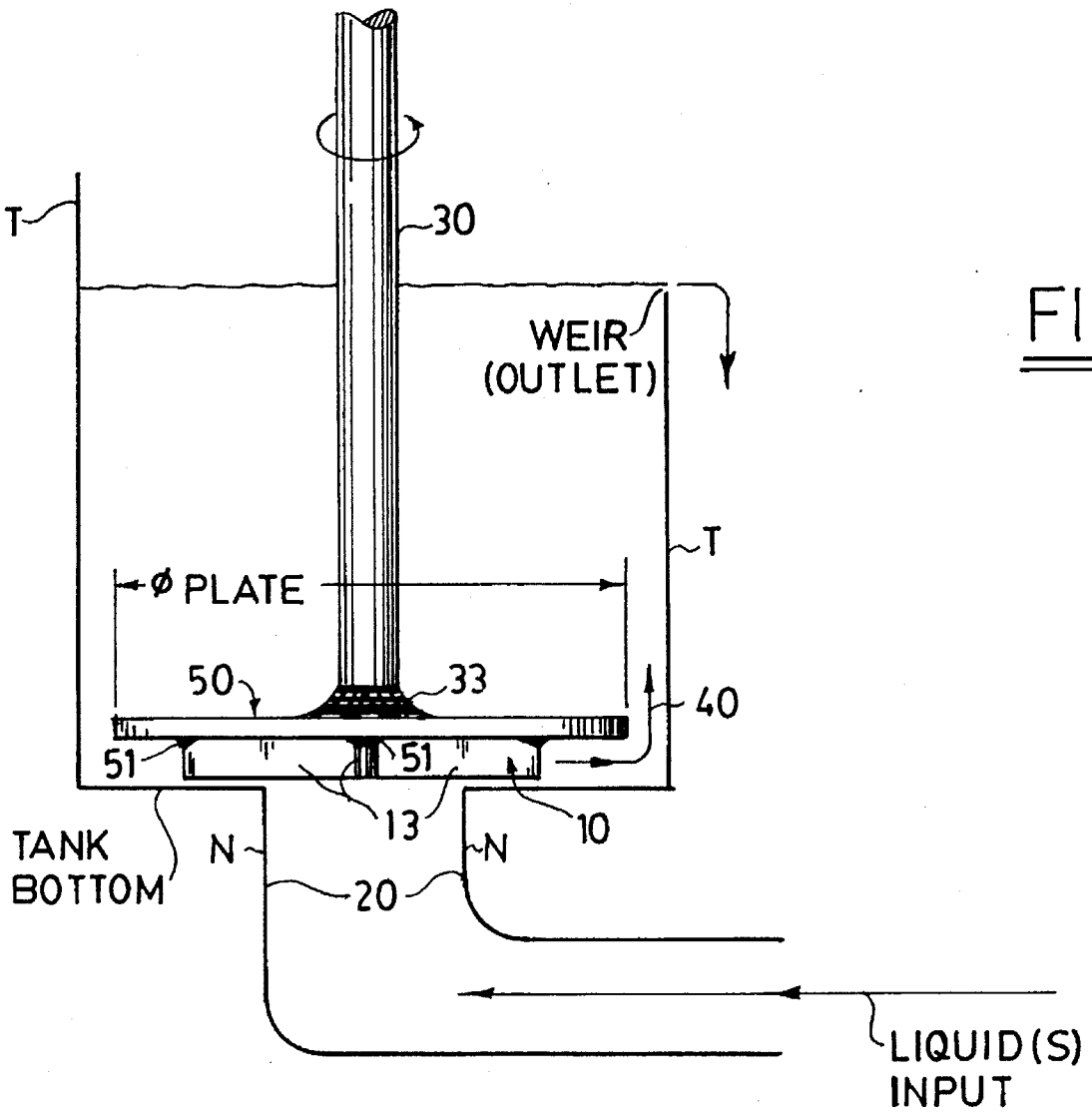
FIG. 3 is a schematic side view of a modified enhanced-flow impeller system in accordance with the first embodiment of the invention in which the radial flow extension plate is depicted as fixedly attached to an upper face of the radial flow impeller, with a lower impeller face disposed proximate an inlet port.

Referring now to FIG. 3, there is shown a schematic side view of a modified enhanced-flow impeller system in accordance with a first embodiment of the invention. Here, a lower or first face of the radial flow impeller 10 is disposed proximate the bottom of a cylindrical tank T and concentric with respect to a cylindrical neck portion N of an inlet port 20 for the liquid or liquids to be pumped.

A circular disk radial flow extension plate 50 of a diameter $Ø_{PLATES}$ extends radially beyond the radially outermost tips of the plurality of impeller blades 13, and is fixedly attached by welds or adhesive bonds 51 to the upper or second face of the impeller 10.

A drive shaft 30 is depicted as being bonded to an upper surface of the plate 50 by a weld or adhesive bond 33, the bond type dependent upon the selection of materials used for the drive shaft, the plate, and the impeller (metals; plastics).

Figure 4:
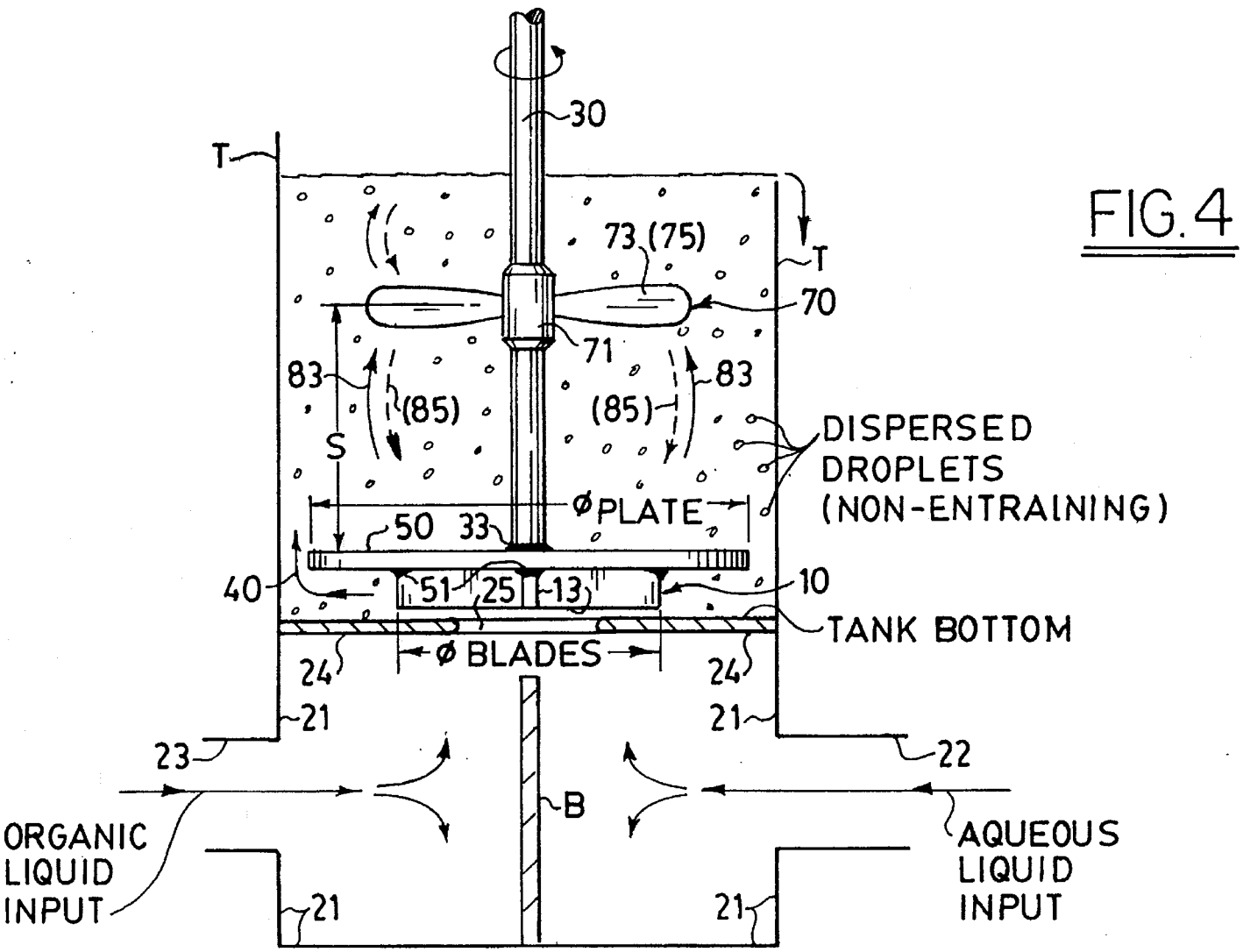
FIG. 4 is a schematic side view of a currently preferred enhanced-flow impeller system in accordance with a second embodiment of the invention in which a dispersion of droplets is formed in a mixer tank among at least two immiscible liquids by a radial flow impeller in combination with a radial flow extension plate attached thereto, the dispersion being distributed uniformly throughout the tank by an axial flow impeller disposed on a common drive shaft in an upper portion of the tank.

Referring now to FIG. 4, there is shown a schematic side view of a currently preferred enhanced-flow impeller system in accordance with a second embodiment of the present invention in which a dispersion of droplets is formed in a mixer tank T among at least two immiscible liquids.

An aqueous liquid input and an organic liquid input are indicated by arrows to be directed via respective input pipes 22 and 23 into a plenum-like chamber 21, and the liquids flow from the chamber through an axially concentric aperture 25 in a disk-shaped plate 24 onto the lower face of blades 13 of a radial flow impeller 10. The liquid inputs are partially isolated from one another by a baffle B extending upwardly from a lower surface of the chamber toward the aperture 25.

A radial flow extension plate 50 is fixedly attached to an upper or second face of the impeller 10 in a manner as previously described with reference to FIG. 3. An impeller shaft 30 is schematically shown attached to an upper surface of the plate 50 (see FIG. 3).

An axial flow impeller 70 is mounted to the drive shaft 30 via a hub 71 in an upper portion of the mixer tank T and at an axial spacing S from the upper surface of the radial flow extension plate 50. The axial flow impeller 70 has a plurality of pitched impeller blades (only two blades are shown). In order to simplify the drawing, impeller blades 73 may be envisioned as having a pitch such that the rotating blades provide an upwardly directed component 83 of axial liquid flow (solid arrows), whereas impeller blades (75) are intended to have a pitch so as to generate a downwardly directed component (85) of axial liquid flow (dashed arrows).

While the primary function of the axial flow impeller 70 is to provide a uniform spatial distribution of the dispersion of droplets throughout the mixer tank T, the selection of up-flow or down-flow inducing impeller blades 73 (75) may additionally influence certain features of the dispersion of droplets created primarily by stress-inducing forces (for example, shear forces, turbulence-induced forces, and drag forces) imparted to the liquids by the radial flow impeller 10 in conjunction with the radial flow extension plate 50. Under certain operating conditions (types of liquids used; viscosities of liquids; relative liquid input levels, and the like), the direction of axial flow provided by the impeller 70 may, for example, favor the formation of a dispersion of droplets of the aqueous liquid(s) in the organic liquid(s) in one axial flow direction, and enhance the formation of droplets of the organic liquid(s) in the aqueous liquid(s) in an opposing axial flow direction.

Experimental results have confirmed that the addition of an axial flow impeller 70 to the radial flow impeller 10 and the plate 50 provides an impeller system capable of producing a uniform spatial distribution of the droplet dispersion throughout the volume of the tank, while consuming substantially less power in providing that axially directed flow component of the dispersion than would be required in the absence of the upper impeller. The choice of any particular axial separation S of the axial flow impeller 70 from the top of the plate 50 depends, among other factors, on the anticipated viscosity of the organic liquid and the aqueous liquid fed into the mixer tank at the inlet port 20 and, more importantly, on the depth of the liquids above the plate 50. Accordingly, in new installations of mixer tanks having the impeller system of the present invention (comprising a radial flow impeller, the radial flow extension plate, and an axial flow impeller) the tank and the impeller system would have dimensional design details in consideration of such aspects as the types and the viscosities and the level of the liquids anticipated in a process. Of course, the flow rates of the liquids and the tank size or volume and the tank shape also influence these and other dimensional design details.

Thus, when designing the enhanced-flow impeller system of the invention for a particular pumping and mixing application in a mixer tank, the radial flow impeller in conjunction with the radial flow extension plate and the axial flow impeller are designed such that the impeller system is operative to provide an optimized pumping effectiveness for a particular droplet dispersion to be created and pumped in a particular tank. Stated differently, the impeller system is configured to provide comparable pumping effectiveness for the axial flow impeller and for the radial flow impeller with its extension plate. In this configuration, the radial flow extension plate 50 can be effective if it extends radially outwardly to at least the blade terminating circle described by the tips of the blades 13.

It is anticipated that new installations of the impeller system in accordance with the invention will be constructed of metals or, alternatively of molded fibrous and plastic materials. Such fibrous and plastic materials may also be advantageously used to construct the mixer tank T. An axial flow impeller and impeller shaft constructed of a composite of fibrous and plastic material has been disclosed in U.S. Pat. No. 4,722,608, issued Feb. 2, 1988, and assigned to the same assignee as the present invention. The design considerations incorporated in that disclosure can be used to design and fabricate an integrated impeller system of a fibrous and plastic material composite which includes the drive shaft 30, a suitably positioned axial flow impeller 70, and a radial flow impeller 10. Furthermore, complete new impeller systems in accordance with the invention can incorporate the radial flow extension plate 50 also fabricated from a composite of fibrous and plastic materials and integrally bonded to the upper face of the radial flow impeller 10 so that such extension plate 50 becomes an integral and rotating part of the impeller system.

The effectiveness of the impeller system of FIG. 4 in providing a spatially uniform distribution of dispersed droplets created by the radial flow impeller 10 at a significantly enhanced liquid flow rate (when used in conjunction with the radial flow extension plate 50) and alternatively at a reduced power level applied to the drive shaft 30, permits the construction of a mixer tank T of reduced volume under otherwise comparable conditions of forming a liquid-liquid dispersion.

Figure 5A:
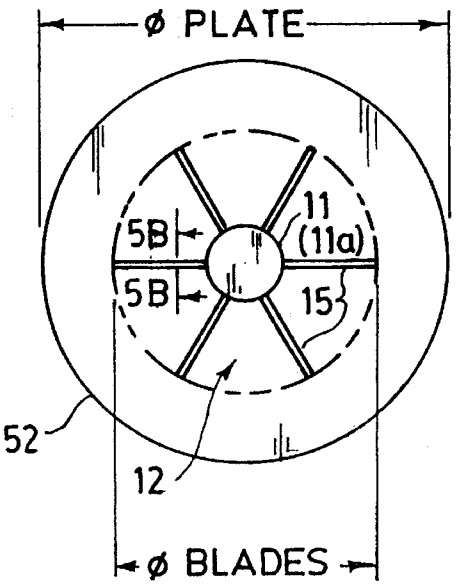
FIG. 5A is a plan view of a straight-bladed radial flow impeller as viewed from the bottom of the tank of FIG. 2, and a radial flow extension plate of circular shape radially extending outwardly beyond a blade termination circle.

Referring now to FIG. 5A, there is shown a schematic plan view of a straight-bladed radial flow impeller 12 having blades 15 emanating from a hub 11, and having radially outermost blade tips terminating on a blade termination circle having a diameter $Ø_{BLADES}$ . A circular radial flow extension plate 52 has a diameter $Ø_{PLATE}$ whereby the ratio of the plate diameter to the diameter of the blade termination circle has at least a value of 1.1. The plan view of FIG. 5A appears as viewed from the bottom of the tank T in FIGS. 3 and 4.. The radial flow extension plate 52 can be fixedly attached to an upper face of the radial flow impeller 12, and alternatively, it can be disposed in a non-rotating manner adjacently above (see FIG. 2) that face of the impeller by suitable mounting means 60. It should be noted that the hub 11 is not required in impeller designs having the impeller blades 15 attached to the plate 52 or to another blade supporting means. In the absence of a hub, the blades emanate from a circle of a diameter (11*a*) which may be greater or less than the hub diameter indicated in FIG. 5A.

Figure 5B:
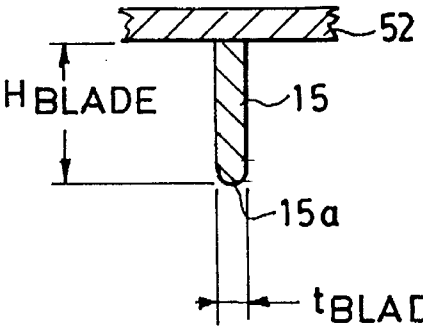
FIG. 5B is a schematic sectional view of one impeller blade of the impeller of FIG. 5A, showing an arcuate surface on one blade face.

Referring now to FIG. 5B, there is shown a schematic sectional view of an impeller blade 15 and a portion of the plate 52, taken along the lines 5B—5B in FIG. 5A. The blade 15 has a blade height $H_{BLADE}$ and a blade thickness $t_{BLADE}$. An arcuate lower blade surface 15*a* may be a radius equivalent to one half of the blade thickness. Such arcuate lower blade surface may be particularly desirable when the impeller 12 is constructed of fibrous and plastic composite materials.

Figure 6:
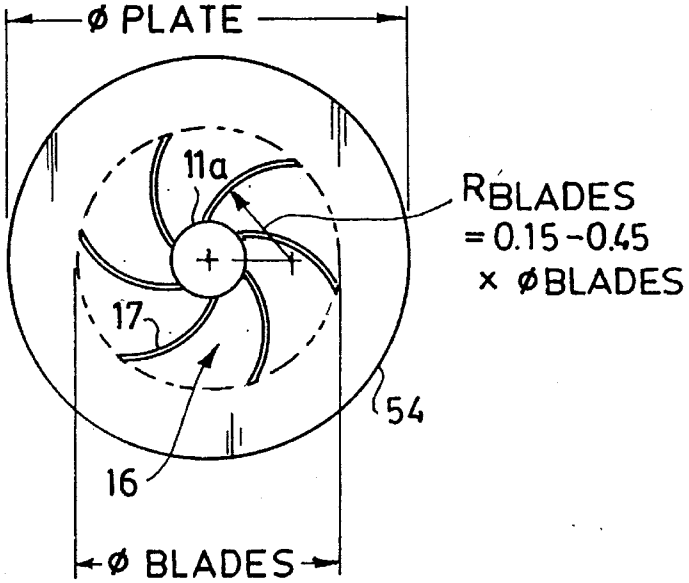
FIG. 6 is a plan view of a radial flow impeller having curved blades, as seen from the liquid inlet port of FIG. 2, and having a circular radial flow extension plate which radially extends outwardly beyond a blade termination circle.

Referring now to FIG. 6, there is shown a currently preferred embodiment of a radial flow impeller 16 having curved impeller blades 17 which are attached (for example by welding as depicted in FIGS. 3 and 4) to a radial flow extension plate 54 in such a manner that the radially innermost blade ends emanate from an axially concentric circle of a diameter 11 a shown in dashed outline, and wherein the radius of curvature $R_{BLADE}$ of each blade is in the range of from 0.15–0.45 of the diameter $Ø_{BLADES}$ of the blade termination circle as described by the tips of the curved blades. A circularly shaped, disk-like, radial flow extension plate 54 can be disposed adjacently above one face of the impeller 16 and supported at the tank bottom or the tank sidewall by means previously described, and, alternatively, the plate 54 can be fixedly attached to that face of the radial flow impeller 16 through suitable means. Again, the previously described and unexpected advantages of the radial flow extension plate 54 are evidenced when the plate diameter is at least 1.1 times the diameter of the blade termination circle.

Figure 7:
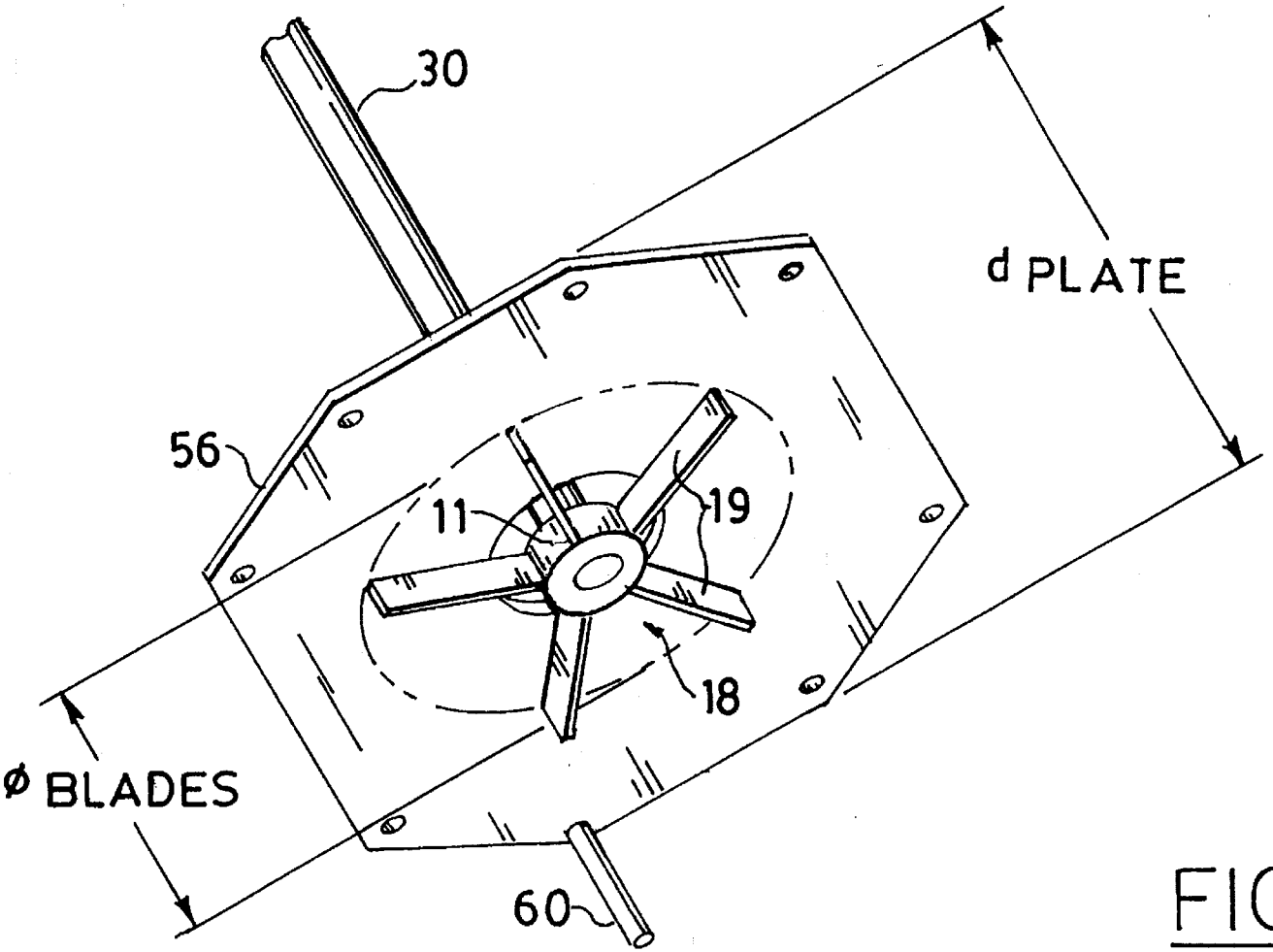
FIG. 7 is a perspective view of a straight-bladed radial flow impeller having impeller blades with blade tips terminating along a circle, and a hexagonally shaped radial flow extension plate indicated as mounted stationarily adjacent to an upper face of the impeller.

Referring now to FIG. 7, there is schematically depicted a straight-bladed radial flow impeller 18 having blades 19. The blades 19 are shown here for illustrative purposes only as originating from a hub 11. Of course, when other mounting means are to be used for attaching the impeller 18 to a drive shaft or when alternative blade support means are selected, a hub would not be used. In this case, the innermost blade terminations can, if desirable, originate further inwardly toward the center or further outwardly therefrom. A radial flow extension plate 56 shaped as a regular hexagon has a narrowest dimension $d_{PLATE}$ which is, in accordance with the invention, at least 1.1 times larger than the blade termination circle $Ø_{BLADES}$ described by the tips of the blades 19 of the radial flow impeller 18. The perspective view of FIG. 5 resembles a perspective view as seen from the liquid inlet port 20 of FIG. 2. The stationary radial flow extension plate 56 is preferably used in a tank having hexagonal tank walls.

While the advantages of the impeller system, in accordance with the invention, are observed for each one of a number of radial flow impellers (used in conjunction with a radial flow extension plate) differing in the degree of curvature of the impeller blades (from the straight blades of FIGS. 5A and 7 to the curved blades of FIG. 6), currently best results are obtained with an impeller system of the invention in which the dispersion-creating radial flow impeller has curved impeller blades.

Another aspect of impeller blades of the radial flow impeller (also referred to as the pumper impeller) which can be optimized for new installations of an impeller system in accordance with the present invention is the ratio of the height or depth of the blades to the diameter of the blade terminating circle described by the blade tips upon impeller rotation. Depending on the particular requirements of liquid pressure ("head") and liquid flow to be achieved by a selected impeller system in a selected pumper or mixer tank, an optimum ratio in the range of from about 0.125 to about 0.3 of the blade height or depth to the blade terminating circle diameter is desirable.

Figure 8A:
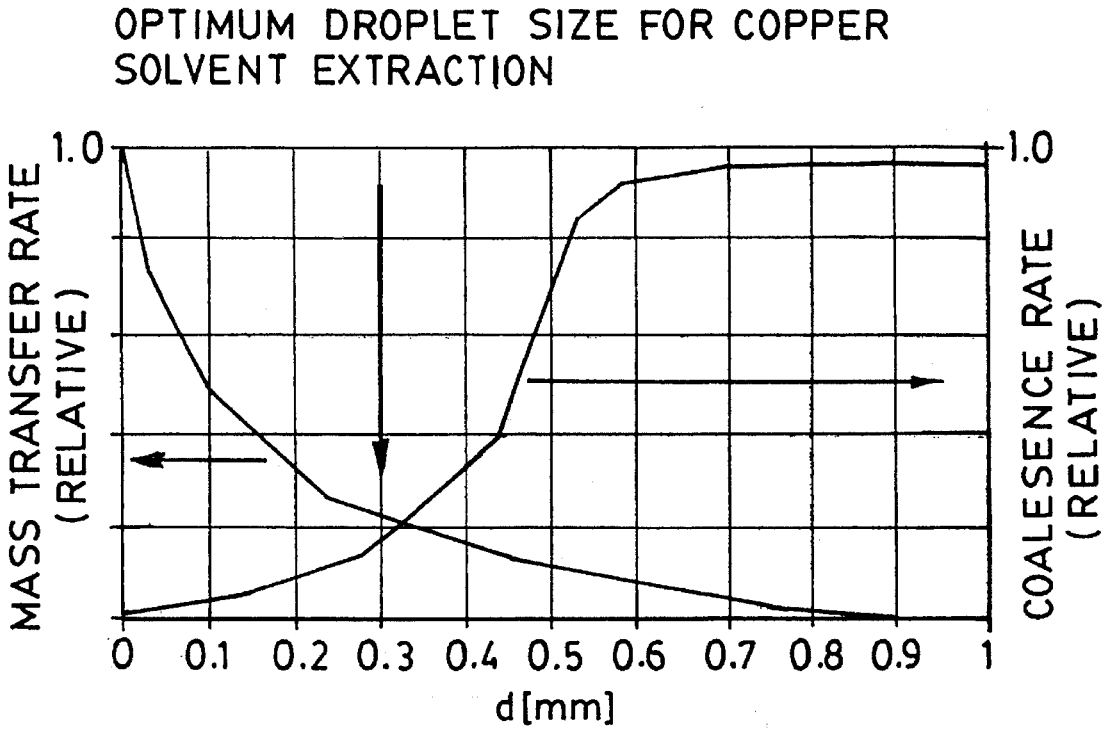
FIG. 8A shows plots schematically representing a relationship between a relative mass transfer rate and a droplet coalescence rate as a function of droplet diameter in a dispersion of two immiscible liquids, wherein an optimum droplet size is indicated at the crossover between the mass transfer function and the droplet coalescence function.

Referring now to FIG. 8A, there are shown idealized plots schematically representing a relationship between a relative mass transfer rate and a coalescence rate of a dispersion of droplets of one liquid in another immiscible liquid with respect to a droplet diameter. From these plots, which shows operation in a solvent extraction process, an optimum droplet size of approximately 0.3 mm droplet diameter can be readily identified as being located at the crossover of the two functional relationships. Of course, another value of an optimum droplet size would be found for different operating conditions (such as, for example, the liquid flow through the mixer tank, the viscosity of the liquids, the design details of the droplet dispersion-creating radial flow impeller, and the like). However, even under such differing conditions, the crossover between the mass transfer rate trace and the coalescence rate trace would provide an optimum droplet size for a dispersion created in a mixer tank.

Figure 8B:
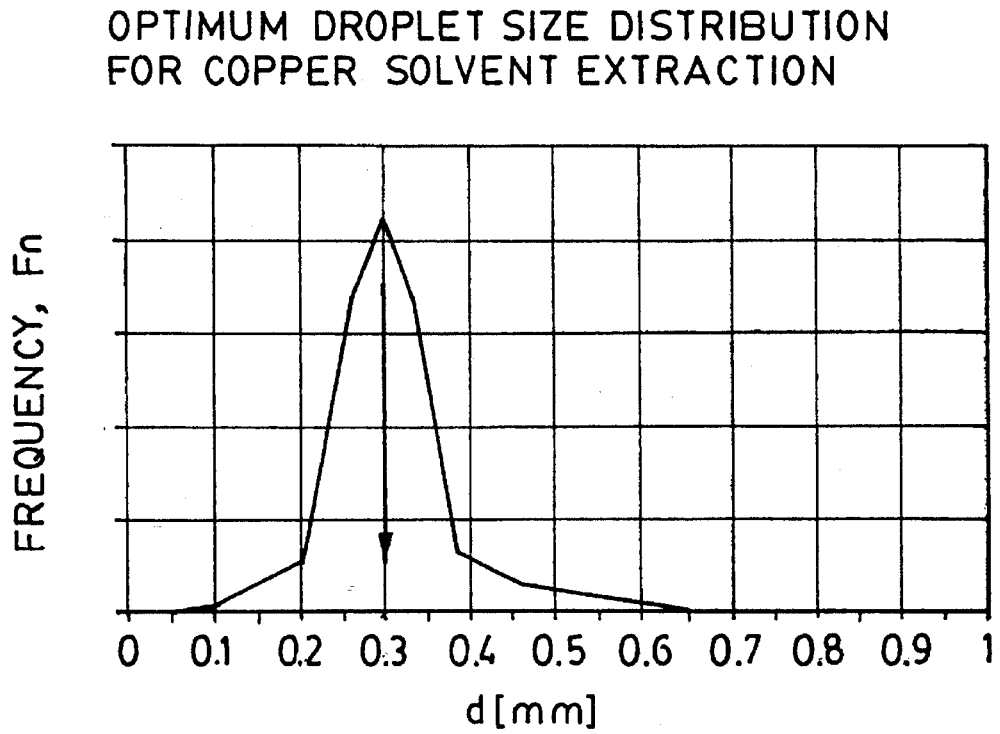
FIG. 8B indicates schematically a trace representing an optimum droplet size distribution for the optimum droplet size depicted in FIG. 8A.

Referring now to FIG. 8B, there is shown a schematic representation of an optimum droplet size distribution derived from the plots of FIG. 8A. Not unexpectedly, it is seen that the idealized optimum droplet size distribution is relatively narrow and centered about a droplet diameter of 0.3 mm, with about 80 percent of the droplets distributed over a droplet diameter range from about 0.2 to 0.4 mm.

As indicated previously, with respect to FIG. 8A, the optimum droplet size distribution would be different or shifted to larger or smaller optimum droplet size when changes are made to the operating characteristics of a mixer tank.

Figure 9:
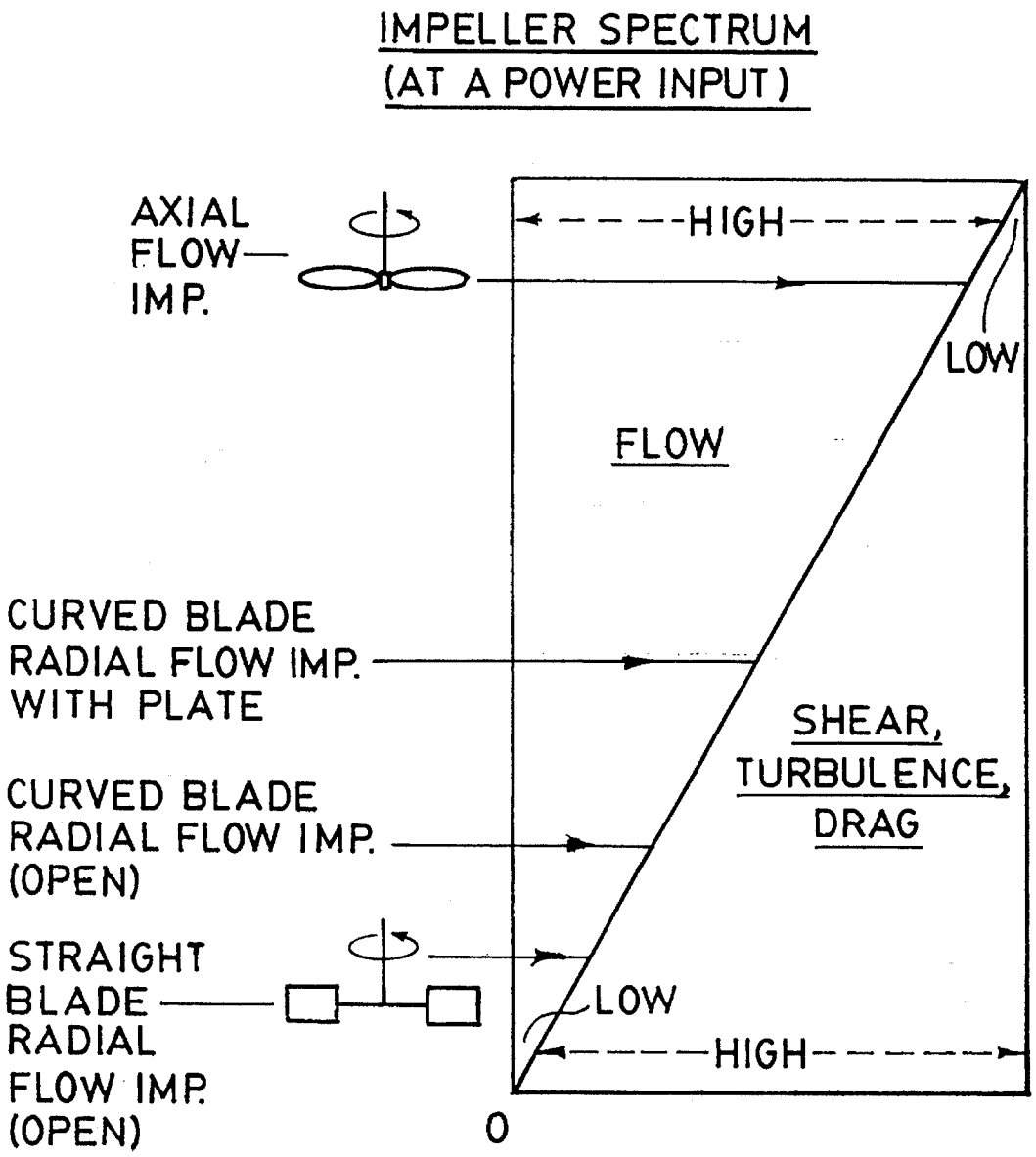
FIG. 9 is a so-called impeller spectrum in which the total power imparted to an impeller or impeller system is the sum of the fraction of power used to generate flow, and to provide shear, turbulence, and drag. Schematically indicated along one vertical axis of the impeller spectrum are various impeller configurations, including a portion of the impeller system in accordance with the present invention.

Referring now to FIG. 9, there is shown a schematic impeller spectrum indicating the relative performance of various impellers and impeller configurations with respect to providing flow and, alternatively, shear, turbulence, and drag at a selected power level imparted to an impeller. All the impeller configurations schematically indicated along the vertical axis are of nominally identical blade tip diameter and have the same number of impeller blades. It is evident from FIG. 9 that an axial flow impeller provides relatively high flow and low shear, turbulence, and drag forces, whereas an open-faced straight-blade radial flow impeller is indicated as generating relatively low flow but high shear, turbulence, and drag forces on a liquid. An open-faced curved-blade radial flow impeller provides slightly more flow than the open-faced straight-blade impeller. A curved-blade radial flow impeller with a radial flow extension plate on one face thereof (see FIG. 3) generates substantially more flow than the open-faced straight-blade radial flow impeller, while still providing about 50 percent of the shear, turbulence, and drag forces acting upon a liquid or liquids. Thus, it can be appreciated that in a currently preferred embodiment of the impeller system of the present invention a curved-blade radial flow impeller with a radial flow extension plate on or adjacently above an upper impeller face provides enhanced flow while being capable of creating a droplet dispersion of non-entraining droplet sizes.

From the foregoing description of the embodiments, it will be apparent that an enhanced-flow impeller system has been provided for enhanced-flow pumping and mixing applications of liquids, including the forming of a dispersion of droplets of at least one liquid in at least one other immiscible liquid in a single mixer tank suitable for use in a metallurgical solvent extraction process. With the impeller system, a radial flow impeller having radial flow inducing blades creates the dispersion of droplets in a lower portion of a mixer tank. A radial flow extension plate fixedly attached to an upper face of the radial flow impeller, and, alternatively, disposed adjacently thereto, extends radially outwardly at least to the radially outermost terminations of the blades, whereby a radially extended zone of enhanced radial liquid flow is achieved and a droplet dispersion is created with enhanced effectiveness. An axial flow impeller disposed on a common drive shaft in an upper portion of the mixer tank provides a uniform distribution of the created droplet dispersion throughout the mixer tank during a dispersion residence time therein. Various modifications to the arrangement of the impeller system can be contemplated. For example, radial flow impellers having particularly arranged curved impeller blades may be advantageously used in the practice of the invention. Additionally numerous means for mounting a stationary radial flow extension plate adjacently above one face of the radial flow impeller or to fixedly attach such a plate to an impeller lace will undoubtedly suggest themselves to those skilled in this art. These and other modifications are within the spirit and scope of the invention, as defined in the specification and the claims.

What is claimed is:

1. An enhanced-flow impeller system for pumping at least one liquid in a tank through an outlet port thereof, comprising:

a radial flow impeller rotatably driven by a drive shaft and having a plurality of radial flow inducing blades having radially outermost blade tips terminating along a blade terminating circle, and pumping said at least one liquid, a first face of said radial flow impeller disposed proximate the bottom of said tank; and a radial flow extension plate disposed adjacent a second opposing face of said radial flow impeller and extending radially outwardly therealong by a radial distance beyond said blade terminating circle.

2. The impeller system of claim 1, wherein said first impeller face extends into an inlet port for said liquid disposed at the bottom of said tank and concentric with said drive shaft.

3. The impeller system of claim 1, wherein said radial flow inducing blades are curved blades having a radius of curvature in a range of from 0.15 to 0.45 of the diameter of said blade terminating circle, said tank having a cylindrically shaped tank wall and said extension plate is a circular disk of a diameter which is at least 1.1 times larger than the diameter of said blade terminating circle.

4. The impeller system of claim 3, wherein said extension plate is fixedly attached to said second opposing face of said radial flow impeller.

5. The impeller system of claim 3, wherein said extension plate is stationarily disposed adjacent said second opposing face of said radial flow impeller.

6. The impeller system of claim 1, wherein said radial flow inducing blades are curved blades having a radius of curvature in a range of from 0.15 to 0.45 of the diameter of said blade terminating circle, said tank having a regular polygon shaped tank wall and said extension plate has a regular polygonal perimeter with a narrowest polygonal dimension being at least 1.1 times larger than the diameter of said blade terminating circle.

7. The impeller system of claim 6, wherein said extension plate is stationarily disposed adjacent said second opposing face of said radial flow impeller.

8. The impeller system of claim 6, wherein said polygon shaped tank wall and said polygonal plate perimeter are one and the same regular polygonal outline.

9. The impeller system of claim 8, wherein said regular polygonal outline is at least a four-sided polygon.

10. The impeller system of claim 1, wherein said radial flow-inducing blades have a blade height dimension extending between said first and second opposing impeller faces, said blade height dimension being in the range of from 0.125 to 0.3 of the diameter of said blade terminating circle.

11. The impeller system of claim 10, wherein said extension plate is fixedly attached to said second opposing face of said radial flow impeller.

12. The impeller system of claim 1, wherein said radial flow inducing blades are straight blades, said tank having a cylindrically shaped tank wall and said extension plate is a circular disk of a diameter which is at least 1.1 times larger than the diameter of said blade terminating circle.

13. The impeller system of claim 12, wherein said extension plate is stationarily disposed adjacent said second opposing face of said radial flow impeller.

14. The impeller system of claim 1, wherein said radial flow-inducing blades are straight blades, said tank having a regular polygon shaped tank wall and said extension plate has a regular polygonal perimeter with a narrowest polygonal dimension being at least 1.1 times larger than the diameter of said blade terminating circle.

15. The impeller system of claim 14, wherein said extension plate is stationarily disposed adjacent said second opposing face of said radial flow impeller.

16. The impeller system of claim 14, wherein said polygon shaped tank wall and said polygonal plate perimeter have a similar regular polygonal outline.

17. The impeller system of claim 16, wherein said regular polygonal outline is at least a four-sided polygon.

18. An enhanced-flow impeller system for forming a dispersion of non-entraining droplets of at least one liquid in at least one other immiscible liquid in a tank and pumping said dispersion through an outlet port of said tank, the system comprising:

a radial flow impeller rotatably driven by a drive shaft and having a plurality of radial flow inducing blades having radially outermost blade tips terminating along a blade terminating circle and providing stress inducing threes on the liquids so as to create and pump said dispersion of droplets, a first face of said radial flow impeller disposed proximate an inlet port for said liquids at the bottom of said tank and concentric with said drive shaft;

a radial flow extension plate disposed adjacent a second opposing face of said radial flow impeller and extending radially outwardly therealong by a radial distance at least to said blade terminating circle; and an axial flow impeller rotatably driven by said drive shaft and having a plurality of pitched axial flow inducing blades with blade tips extending radially outwardly to at least said blade terminating circle of said radial flow impeller, said axial flow impeller disposed on said drive shaft at an axial spacing from said plate in a direction toward an upper portion of said tank, and providing a spatially uniform distribution of said droplet dispersion throughout the tank during a dispersion residence time therein.

19. The impeller system of claim 18, wherein said radial flow impeller, said extension plate, said axial flow impeller, said drive shaft, and said tank are constructed of metallic materials.

20. The impeller system of claim 18, wherein said radial flow impeller, said extension plate, said axial flow impeller, said drive shaft, and said tank are constructed of molded fibrous and plastic materials.

21. The impeller system of claim 20, wherein said blades of said molded fibrous and plastic radial flow impeller have an arcuate surface on said first impeller face with a preferred radius of curvature being about one half of a thickness dimension of said blades.

22. The impeller system of claim 18, wherein said pitched axial flow inducing blades of said axial flow impeller are pitched so as to promote an upwardly directed axial flow component of the droplet dispersion in said tank.

23. The impeller system of claim 18, wherein said pitched axial flow inducing blades of said axial flow impeller are pitched so as to promote a downwardly directed axial flow component of the droplet dispersion in said tank.

24. The impeller system of claim 18, wherein said radial flow impeller in conjunction with said extension plate, and said axial flow impeller are operative to provide an optimized pumping effectiveness liar a particular droplet dispersion being created and pumped in a particular tank.

25. The impeller system of claim 18, wherein said stress inducing forces provided by said radial flow impeller are shear and turbulence and drag forces acting on the liquids.

26. The impeller system of claim 18, wherein said first impeller face extends into said inlet port for said liquids.

27. The impeller system of claim 18, wherein said radial flow inducing blades are curved blades having a radius of curvature in a range of from 0.15 to 0.45 of the diameter of said blade terminating circle, said tank having a cylindrically shaped tank wall and said extension plate is a circular disk of a diameter which is at least 1.1 times larger than the diameter of said blade terminating circle.

28. The impeller system of claim 27, wherein said extension plate is fixedly attached to said second opposing face of said radial flow impeller.

29. The impeller system of claim 27, wherein said extension plate is stationarily disposed adjacent said second opposing face of said radial flow impeller.

30. The impeller system of claim 18, wherein said radial flow inducing blades are curved blades having a radius of curvature in a range of from 0.15 to 0.45 of the diameter of said blade terminating circle, said tank having a regular polygon shaped tank wall and said extension plate has a regular polygonal perimeter with a narrowest polygonal dimension being at least 1.1 times larger than the diameter of said blade terminating circle.

31. The impeller system of claim 30, wherein said extension plate is stationarily disposed adjacent said second opposing face of said radial flow impeller.

32. The impeller system of claim 30, wherein said polygon shaped tank wall and said polygonal plate perimeter have a similar regular polygonal outline.

33. The impeller system of claim 32, wherein said regular polygonal outline is at least a four-sided polygon.

34. The impeller system of claim 18, wherein said radial flow-inducing blades have a blade height dimension extending between said first and second opposing impeller faces, said blade height dimension being in the range of from 0.125 to 0.3 of the diameter of said blade terminating circle.

35. The impeller system of claim 18, wherein said radial flow inducing blades are straight blades, said tank having a cylindrically shaped tank wall and said extension plate is a circular disk of a diameter which is at least 1.1 times larger than the diameter of said blade terminating circle.

36. The impeller system of claim 35, wherein said extension plate is fixedly attached to said second opposing face of said radial flow impeller.

37. The impeller system of claim 35, wherein said extension plate is stationarily disposed adjacent said second opposing face of said radial flow impeller.

38. The impeller system of claim 18, wherein said radial flow inducing blades are curved blades having a radius of curvature in a range of from 0.15 to 0.45 of the diameter of said blade terminating circle, said tank having a regular polygon shaped tank wall and said extension plate has a regular polygonal perimeter with a narrowest polygonal dimension being at least 1.1 times larger than the diameter of said blade terminating circle.

39. The impeller system of claim 38, wherein said extension plate is stationarily disposed adjacent said second opposing face of said radial flow impeller.

40. The impeller system of claim 38, wherein said polygon shaped tank wall and said polygonal plate perimeter have a similar regular polygonal outline.

41. The impeller system of claim 40, wherein said regular polygonal outline is at least a four-sided polygon.

42. The impeller system of claim 18, wherein a baffle extends vertically upwardly along said inlet port for said liquids from a lower inlet port surface toward said first face of said radial flow impeller.

43. The impeller system of claim 18, wherein said radial flow extension plate extends beyond said blade terminating circle.

44. A method for pumping with enhanced flow at least one liquid in a tank from an inlet port through an outlet port thereof, the method comprising the steps of:

providing a radial flow impeller having a first face of a plurality of radial flow inducing blades extending into said inlet port for said at least one liquid disposed at a bottom surface of said tank, said blades having radially outermost blade tips terminating along a blade terminating circle;

providing a radial flow extension plate disposed adjacent a second opposing face of said radial flow impeller and extending radially outwardly therealong by a radial distance beyond said blade terminating circle; and pumping said at least one liquid by rotatably driving a drive shaft attached to at least said radial flow impeller.

45. A method for forming and pumping with enhanced flow a dispersion of non-entraining droplets of at least one liquid in at least one other imnmiscible liquid in a tank from an inlet port through an outlet port thereof, the method comprising the steps of:

providing a radial flow impeller having a first face of a plurality of radial flow inducing blades disposed proximate an inlet port for said at least two liquids at a bottom surface of said tank, said blades having radially outermost blade tips terminating along a blade terminating circle;

providing a radial flow extension plate disposed adjacent a second opposing face of said radial flow impeller and extending radially outwardly therealong by a radial distance at least to said blade terminating circle;

providing in an upper portion of said tank an axial flow impeller rotatably driveable by a drive shaft common to at least said radial flow impeller, said axial flow impeller having a plurality of pitched axial flow inducing blades with blade tips extending radially outwardly to at least said blade terminating circle of said radial flow impeller; and rotatably driving said drive shaft, thereby creating said droplet dispersion by stress inducing forces acting on said at least two liquids and provided by said radial flow impeller, and pumping with enhanced flow said droplet dispersion by said radial flow impeller and said radial flow extension plate, and forming a spatially uniform distribution of said droplet dispersion throughout the tank by said axial flow impeller during a residence time of said dispersion in said tank.

46. The method of claim 45, wherein said axial flow impeller providing step includes the step of furnishing said axial flow impeller with axial flow inducing blades having a pitch which promotes an upwardly directed axial flow component of the droplet dispersion in said tank.

47. The method of claim 45, wherein said axial flow impeller providing step includes the step of furnishing said axial flow impeller with axial flow inducing blades having a pitch which promotes a downwardly directed axial flow component of the droplet dispersion in said tank.

* * * * *